US005153371A

United States Patent [19]

Grau et al.

[11] Patent Number: 5,153,371

[45] Date of Patent: Oct. 6, 1992

[54] RIBBON STABILIZER FOR A WEAPON

[75] Inventors: John C. Grau, Sussex; William G. Kuhnle, Hopatcong; Arthur J. Fiorellini, Mt. Arlington, all of N.J.

[73] Assignee: The United States of America as represented by The Secretary of the Army, Washington, D.C.

[21] Appl. No.: 833,258

[22] Filed: Feb. 10, 1992

[51] Int. Cl.[5] ..... F42B 12/58

[52] U.S. Cl. ..... 102/386; 102/388; 102/393; 102/482; 102/489; 244/138 A; 416/223 R; 446/36; 446/217

[58] Field of Search ..... 102/208, 228, 266, 225, 102/226, 227, 339, 348, 359, 337, 338, 354, 386, 387, 388, 393, 489, 482, 487, 488; 244/138 A; 416/DIG. 2, DIG. 3, 223 R; 446/36, 217, 218

[56] References Cited

U.S. PATENT DOCUMENTS

| | | | |
|---|---|---|---|
| 3,353,486 | 11/1967 | Haiken | 102/208 |
| 3,747,263 | 7/1973 | Grossberg | 446/217 |
| 4,209,151 | 6/1980 | Saunders | 102/356 |
| 4,488,488 | 12/1984 | Looger et al. | 102/387 |
| 4,662,589 | 5/1987 | Allen | 244/138 A |
| 4,777,879 | 10/1988 | Bueno et al. | 102/489 |
| 4,986,185 | 1/1991 | Kuhnle et al. | 102/388 |
| 5,016,533 | 5/1991 | Borngen | 102/386 |
| 5,067,410 | 11/1991 | Murnane, III et al. | 102/489 |

FOREIGN PATENT DOCUMENTS

| | | | |
|---|---|---|---|
| 304254 | 4/1919 | Fed. Rep. of Germany | 102/208 |

*Primary Examiner*—Harold J. Tudor

*Attorney, Agent, or Firm*—Anthony T. Lane; Edward Goldberg; Michael C. Sachs

[57] ABSTRACT

A weapon arranged to travel in a given orientation when in flight, has a body and a ribbon. The body has a payload casing and a spindle rotatably mounted at the rear of the payload casing. The ribbon is formed into a flexible loop for trailing behind the body in flight. This ribbon is attached to the spindle. The ribbon has an impelling surface shaped to apply a torque to the spindle when in flight.

5 Claims, 2 Drawing Sheets

FIG. 7
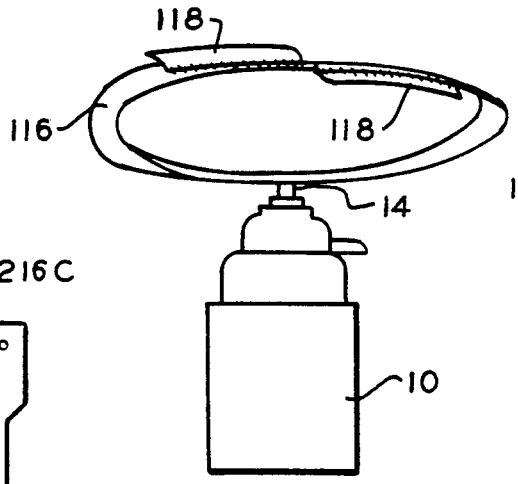
FIG. 8
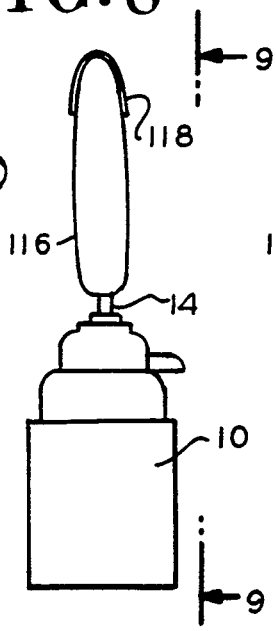
FIG. 9
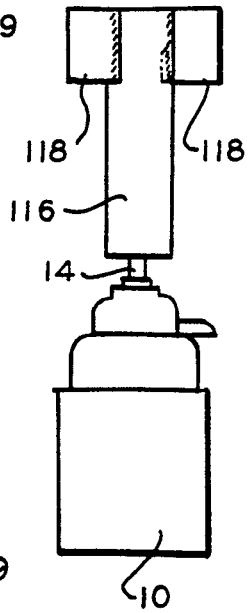
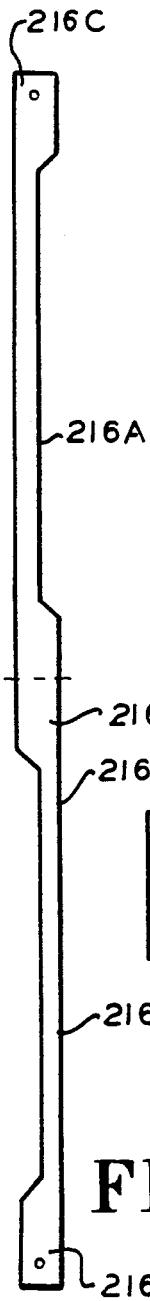
FIG. 11
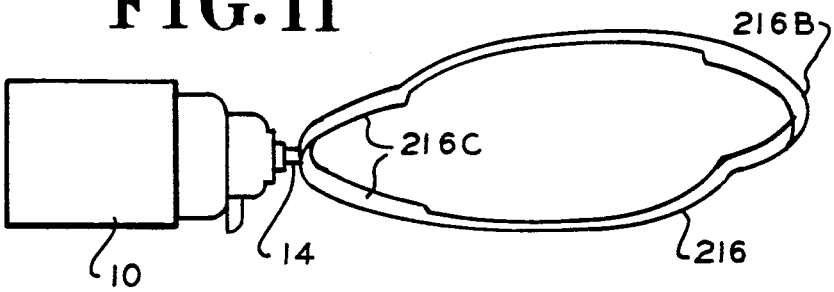
FIG. 12
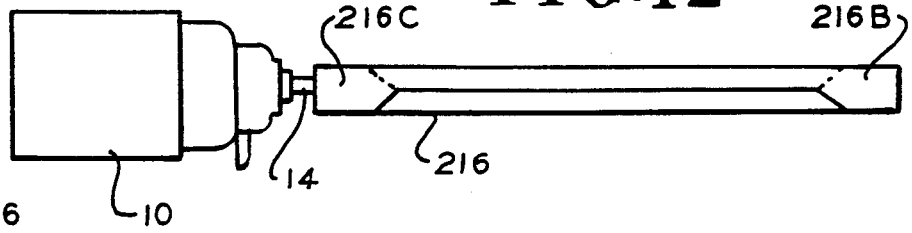
FIG. 13
FIG. 14
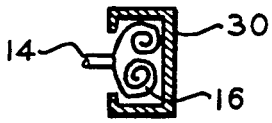

RIBBON STABILIZER FOR A WEAPON

GOVERNMENT INTEREST

The invention described herein may be manufactured, used and licensed by and for the government for governmental purposes without the payment to us of any royalties thereon.

BACKGROUND OF THE INVENTION

The present invention relates to ribbons for orienting weapons in flight, and in particular, to a ribbon formed into a flexible loop for orienting a weapon body.

Known grenade submunitions can be ejected in groups from artillery shells, missiles, rockets etc. Such known grenades employ at their aft end a looped cloth ribbon attached at the fuze of the grenade. Also, banner stabilizers are shown in U.S. Pat. No. 4,209,151.

Once a grenade, for instance in-flight and separated from the launch vehicle, the looped ribbon quickly decelerates the grenade from its initial speed. This initial speed may be in the range of 300 to 1200 feet per second, although other speeds may be experienced for different types of launch vehicles or other weapons. The rapid deceleration causes the grenade to fall vertically, with the ribbon trailing vertically behind. This effect tends to keep the grenades in a desirable group pattern and also causes the grenade to strike a ground target nose first, which orientation may be necessary to reliably detonate the grenade.

If the grenades are initially released from an artillery shell, the high spin rate of the shell causes similar spinning of the grenades. The ribbon, however, reduces the tendency of the grenade to spin. Spin reduction is desirable because spinning adversely affects the dynamics of a shaped charge that may be contained in the grenade. Thus, when the grenade separates from the shell, the ribbon dampens the spinning and simultaneously provides the torque needed to unscrew the firing pin spindle and thereby arm the fuze.

Unscrewing this firing pin spindle can be difficult if the grenade is not initially spinning. For missile launched applications, the drag force in conjunction with the vibration produced by the flapping ribbon must unscrew the firing pin. This method of arming the fuze has proven unreliable and failure can result from small changes in the torque resistance that must be overcome to unthread the arming screw.

Accordingly, there is a need for an improved device for creating the drag necessary to orient a weapon such as a grenade in flight, and also to arm or otherwise operate a fuze to allow detonation.

SUMMARY OF THE INVENTION

In accordance with the illustrative embodiments, demonstrating features and advantages of the present invention, there is provided a weapon arranged to travel in a given orientation when in flight. The weapon has a body with a payload casing, and a spindle rotatably mounted at the rear of the payload casing. The weapon also has a ribbon formed into a flexible loop for trailing behind the body in flight. This ribbon is attached to the spindle and has an impelling surface shaped to apply torque to the spindle when in flight.

In one of the preferred embodiments of the present invention, a nylon ribbon trailing a grenade has two rectangular flaps secured to the outside of the ribbon equidistantly from the spindle. Preferably, the rectangular flap has the same width as the ribbon and is secured by ultrasonic or heat sealing or other means along two of the flap edges: a downstream edge and an adjacent lateral edge. A flap of this nature acts as a scoop or impelling surface that produces drag as well as torque. These two opposing flaps tend to turn the ribbon and the firing pin spindle. Since the scoops tend to increase the drag of the ribbon significantly, the preferred ribbon loop can be shortened to keep the drag equivalent to that produced by a conventional ribbon without flaps. If the ribbon is thus shortened, the entire volume of the ribbon is decreased, which facilitates packing of the weapon.

In another preferred embodiment, two flaps are secured near the downstream end of the looped ribbon. These flaps project in opposite directions from the ribbon and act as impelling surfaces to again turn the spindle.

In still another embodiment, the ribbon is formed with nonlinear edges. In particular, the edges of the ribbon can have steps so that its development is S-shaped. In one preferred embodiment, most of the ribbon has a relatively narrow section with a wider section provided at the downstream end of the ribbon.

These ribbons can be used to turn a spindle that can arm a fuze or can generate an electrical charge. Such an electrical charge can be used to operate a timer to detonate the weapon after a predetermined time delay. This delay ensures detonation of the weapon even if the primary fuze does not operate.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention when taken in conjunction with the accompanying drawings wherein:

FIG. 7 is a side view of a weapon having a ribbon, that is an alternate to that of FIGS. 1-3, wherein the ribbon is shown in perspective;

FIG. 8 is a side view of the weapon of FIG. 7 with the ribbon oriented in a narrow loop and viewed edgewise;

FIG. 9 is a side view of the weapon taken along line 9—9 of FIG. 8;

FIG. 11 is a side view of a weapon having a ribbon, that is an alternate to that of FIGS. 1-3 and 7-9;

FIG. 12 is a side view of the weapon of FIG. 10 with the ribbon faces shown head on;

FIG. 13 is a development showing the ribbon of FIGS. 11-12 laid flat, before assembly; and FIG. 14 is detailed view showing the ribbon of FIG. 1 wound and capped.

DETAILED DESCRIPTION OF THE PREFERRED EMBODIMENTS

Figure 1:
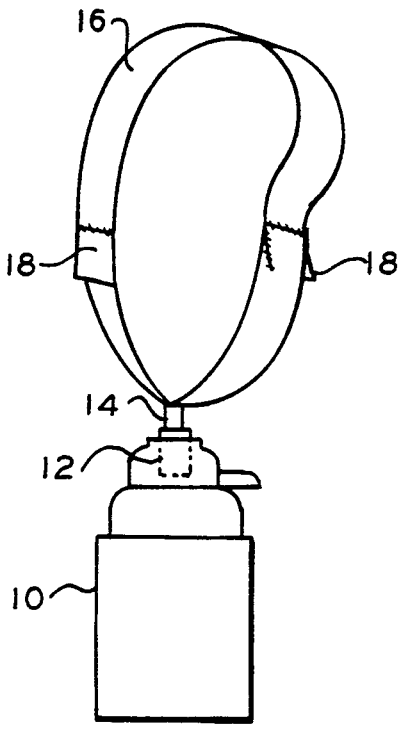
FIG. 1 is a side view of a weapon in accordance with the principles of the present invention with its trailing ribbon shown waving.
Figure 2:
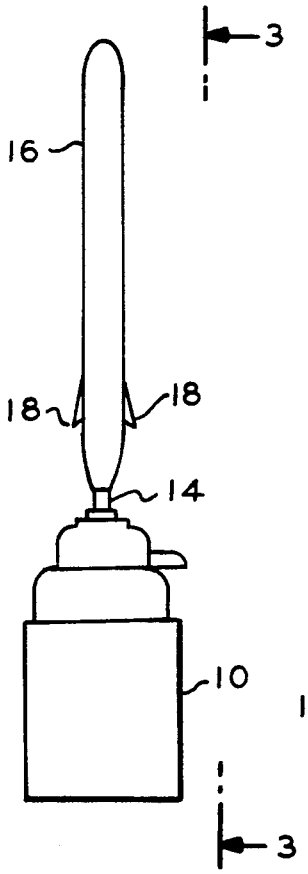
FIG. 2 is a side view of the weapon of FIG. 1 with the ribbon oriented in a narrow loop, that is viewed edgewise.

Referring to FIGS. 1-5, a grenade body is shown as payload casing 10 containing an explosive charge which may be part of a shaped charged device. The grenade may have a utilization means, shown herein as a fuze arming assembly 12. The fuze arming assembly 12 can be a conventional fuze for detonating an explosive charge when the grenade body 10 hits a target axially. Spindle 14 must be rotated before the fuze is operable.

Ribbon 16 is shown herein as a nylon strip having two overlapping ends attached to spindle 14. Ribbon 16 may be a three-quarter inch wide strip having when assembled a circuit length of 13.5 inches (that is, a length of 6¾ inches when folded). It will be appreciated, however, that the dimensions of the ribbon can be altered depending upon the magnitude of drag needed. Also, the ribbon can be formed of Kevlar (TM), various cloth materials, or other materials.

Two flaps 18 are secured to the outside surface of ribbon 16 to form pockets or scoops that act as impelling surfaces. In the disclosed embodiment, flaps 18 are ¾ inch wide and 1 inch long, although other dimensions can be employed, depending upon the drag and impelling torque required by the particular embodiment. The flaps 18 are shown positioned about one quarter of the way toward the outer most end of loop 16, although the position can be varied depending upon the application and the expected airflow around the grenade body 10.

Figure 3:
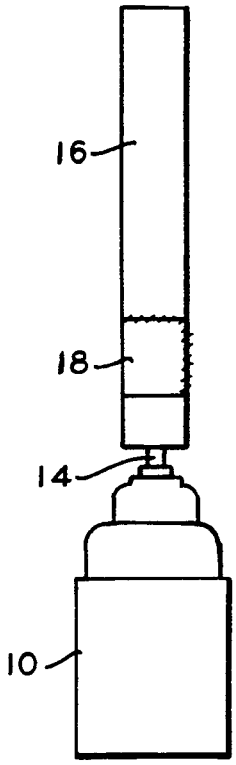
FIG. 3 is a side view of the weapon 2, taken along line 3—3 of FIG. 2
Figure 4:
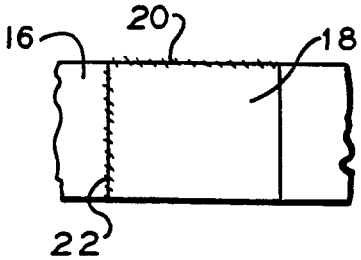
FIG. 4 is a detailed, outside view of one of the flaps of FIG. 3.

Flaps 18 are shown secured to ribbon 16 along their downstream edge 22 (FIG. 4) and along their edge 20 (right edge for the view of FIG. 3). This causes the pocket formed by flap 18 to be open to airflow in a longitudinal direction and in opposing crosswise directions. Flaps 18 can be secured by ultrasonic or heat welding, by stitching, by gluing or by other appropriate means. Flaps 18 can be formed of the same material as ribbon 16, although alternate materials can be used instead.

When grenade body 10 is in flight, air flows around and into the pocket of flaps 18. Because the flaps 18 are open in a crosswise direction, they are urged to the right (as viewed in FIG. 3). Consequently, ribbon 16 can provide a counterclockwise torque to spindle 14 (when spindle 14 is viewed from behind). Moreover, attachment of the flaps can be reversed to provide a torque in the opposite direction, if required.

Figure 6:
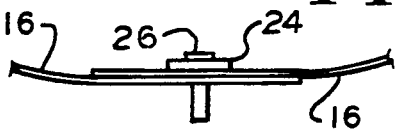
FIG. 6 is an edge view of the joint between the ribbon and spindle of the weapon of FIGS. 1-3.
Figure 5:
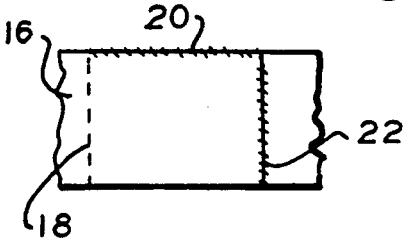
FIG. 5 is a reverse view of the flap and ribbon of FIG. 4.
Figure 10:
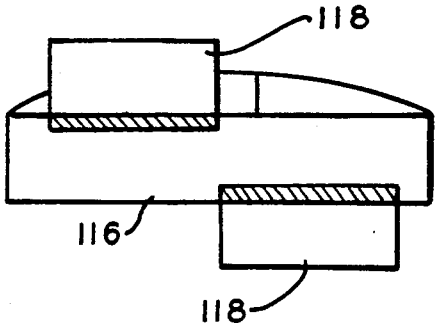
FIG. 10 is a partial top view of the ribbon and flaps of FIGS. 7-9.

FIG. 6 is a detailed edge view of ribbon 16 showing its two overlapping ends fitted over spindle 14. The overlapping ends of ribbon 16 can be bound by ultrasonic welding, stitching, gluing etc. Spindle 14 fits through coincident apertures in the ends of ribbon 16 and into the center of washer 24. Washer 24 and ribbon 16 are held on spindle 14 by peening the end 26 of spindle 14. End 26 can initially have a conical concavity, which facilitates the radial spreading of spindle end 26 when peened. It will be appreciated that other means of securing spindle 14 to ribbon 16 are possible, including rivets, crimps, screws and other fastening means.

Referring to FIGS. 7-10, a weapon is shown with an alternate ribbon 116. Grenade body 10 and spindle 14 are identical to that previously illustrated and therefore bear identical reference numerals. Ribbon 116 can be about the same length and width as the previously illustrated ribbon (ribbon 16 of FIG. 1). As before, the length and width of ribbon 116 can be varied depending upon the torque and drag required from the ribbon.

In this embodiment, a pair of flaps 118 are shown secured to opposite edges of ribbon 116. Flaps 118 are secured toward the outermost end of ribbon 116 and are spaced equidistantly from spindle 14. The longitudinal spacing between flaps 118 can be about a one inch spacing or, as illustrated, no spacing. Flaps 118 are 1 to 1¾ inches long and ¾ inch wide, although other dimensions are possible, depending upon the required drag and torque.

The flaps 118 are oriented to provide an aerodynamic force directed toward the centerline of ribbon 116. This force produces a counterclockwise torque on spindle 14 (when spindle 14 is viewed from behind). Moreover, the orientation of the flaps 118 can be reversed to provide a torque in the opposite direction, if required.

Referring to FIGS. 11-13, ribbon 216 is shown formed into a loop. This loop has a stepped edge 216A, which gives ribbon 216 the S-shaped development illustrated in FIG. 13. FIG. 13 shows the inside surface of ribbon 216. Ribbon 216 has a relatively wide outer section 216B, for example ¾ inch wide. A similarly wide inner section 216C has coincident apertures for receiving previously mentioned spindle 14. Ribbon 216 is so arranged to apply a clockwise torque on spindle 14 (when spindle 14 is viewed from behind). The width and length of the various sections of ribbon 216 can be varied depending upon the desired drag and torque. Also, the orientation of the stepped edges can be reversed to provide a torque in the opposite direction, if required.

To facilitate an understanding of the principles associated with the foregoing apparatus, the operation of the embodiment FIGS. 1-6 will be described, although the operation of the other embodiments is similar. Ribbon 16 is initially prepared by stretching it laterally so it is flat. Next the ribbon is rolled from the two outstretched midpoints to form the side by side rolls illustrated in FIG. 14. Once ribbon 16 is so rolled, cap 30 can be placed over the ribbon to keep it rolled or furled.

The grenade bodies 10 can then be loaded into an artillery shell, missile head or other vehicle by stacking the grenades end to end in a number of columns. The forward end of body 10 has a conical concavity providing space for the capped ribbon. The number of columns of grenades and the number of grenades per column can be varied depending upon the particular weapons system. In some embodiments, the grenades will be packed in columns of 5 to 15 grenades. Spacers are sometimes used between grenades, but such spacers are not always required.

The missile, artillery shell or other vehicle containing the plurality of grenade bodies 10 can be launched normally. In the vicinity of the target, the grenade bodies 10 can be released from the delivery system in the usual fashion. Consequently, the grenades can be travelling separately at speeds of 300 to 1200 feet per second.

Cap 30 (FIG. 14) fits loosely over ribbon 16 so that air turbulence immediately pulls cap 30 off ribbon 16. Consequently, the ribbon is unfurled as shown in FIG. 1, (although at high speeds the ribbon stretches to the configuration shown in FIGS. 2 and 3). The drag produced by flap 18 and ribbon 16 decelerates grenade body 10 so that the grenade begins to fall vertically.

For missile launched grenades, torque from ribbon 16 is the primary mechanism for arming the grenades since the grenades themselves are not spinning. Air flowing across ribbon 16 encounters the pockets formed by flaps 18. Since the pockets of flaps 18 have crosswise openings, the airflow tends to turn ribbon 16 and apply torque to spindle 14. As spindle 14 turns, fuze assembly 12 is armed. When armed, an axial impact, typically at the forward end of grenade body 10, can actuate the fuze and detonate the grenade.

In some embodiments, the spinning of ribbon 16 can produce sufficient energy to produce an electrical charge. This charge can operate a timer that awaits the expiration of a predetermined delay interval before detonating the explosive charge in grenade body 10. This time delay is chosen to occur sometime after the grenade body 10 would be expected to strike the ground or target. This provides a backup detonation so that live grenades are not left strewn about a target site.

It is to be appreciated that various modifications may be implemented with respect to the above described preferred embodiments. While a grenade is illustrated, the foregoing can be applied to any weapon that needs to be oriented in flight and have an arming spindle rotated. Also, the grenade can be launched by various means including missiles, rockets, artillery shells and other devices. Similarly, the grenades can be launched in large or small groups and even individually. The length of the ribbon can be altered depending upon the desired drag and similarly the various dimensions of the flaps can be altered to affect the drag and torque.

Obviously, many modifications and variations of the present invention are possible in light of the above teachings. It is therefore to be understood that within the scope of the appended claims, the invention may be practiced otherwise and as specifically described.

We claim:

1. A weapon comprising a despinning means attached to said weapon, said weapon spinning while in flight, said despinning means adapted to slow the rate of such spinning substantially and to decelerate the weapon is descending, said weapon comprising a body having a payload casing and a spindle mounted at a rear of said payload casing, said despinning means comprising:

only a single essentially rectangular shaped ribbon attached to said spindle, said ribbon having a defined central longitudinal axis, a defined ribbon general width and a defined overall ribbon length, and said ribbon having essentially five consecutive regions along its length, defining:

a first and a fifth region being at ends of said ribbon, and being essentially rectangular in shape and as wide as the defined ribbon general width;

a second and a fourth region of said ribbon respectively adjacent to said first and said fifth regions respectively, said second and fourth regions being essentially rectangular in shape, said second and fourth regions each being of a width lesser than said ribbon general width, said lesser width formed by cutting away a portion of the ribbon width on one side only of said ribbon longitudinal axis, within each said second and fourth region, wherein the side of said longitudinal axis on which the ribbon is cut is opposite between said second and said fourth regions; and wherein said second and fourth regions respectively join to the adjacent respective said first and third regions at taper zones where the width of said ribbon transitions in size from one region to the next;

a third region being essentially rectangular in shape and as wide as the defined ribbon general width, and wherein said third region joins adjacently to said second and fourth regions at taper zones where the width of the ribbon transitions in size from one region to the next; and wherein the taper zones are formed of straight taper lines to transition the width from region to region; and wherein said ribbon is formed into a single flexible loop for trailing behind said body in flight, said ribbon being attached to said spindle and applying a torque to said spindle when in flight, due to aerodynamic drag on said ribbon which spins in flight relative to said weapon; said first and said fifth regions are overlapped and joined to form said loop, said first and fifth regions each having coincident apertures there through in which said ribbon is secured to said spindle.

2. The weapon according to claim 1 wherein said spindle is rotatable and wherein said weapon additionally comprises a utilization means coupled to said spindle to affect said weapon upon rotation of said spindle, said ribbon applying a torque to said spindle due to aerodynamic drag on said ribbon in flight, causing operation of said utilization means by rotating said spindle.

3. The weapon according to claim 2 wherein said weapon additionally comprises a fuze and an explosive charge, said utilization means being operable to arm said weapon to enable said fuze to detonate said explosive charge.

4. The weapon according to claim 1 wherein said weapon is a grenade.

5. The weapon according to claim 1 wherein the material of said ribbon is nylon.

* * * * *